US008377862B2

(12) United States Patent
Murkunde et al.

(10) Patent No.: US 8,377,862 B2
(45) Date of Patent: Feb. 19, 2013

(54) SPRAY-DRYING PROCESS

(75) Inventors: Rohan Govind Murkunde, Morpeth (GB); Barry Rowland, Sunderland (GB)

(73) Assignee: The Procter & Gamble Company, Cincinnati, OH (US)

( * ) Notice: Subject to any disclaimer, the term of this patent is extended or adjusted under 35 U.S.C. 154(b) by 187 days.

(21) Appl. No.: 12/722,692

(22) Filed: Mar. 12, 2010

(65) Prior Publication Data

US 2010/0230840 A1 Sep. 16, 2010

Related U.S. Application Data

(60) Provisional application No. 61/159,884, filed on Mar. 13, 2009.

(51) Int. Cl.
*C11D 17/00* (2006.01)

(52) U.S. Cl. ..... 510/443; 510/444; 510/445; 510/446; 510/452

(58) Field of Classification Search ..... None
See application file for complete search history.

(56) References Cited

U.S. PATENT DOCUMENTS

| | | | | |
|---|---|---|---|---|
| 3,849,327 | A * | 11/1974 | DiSalvo et al. | 510/349 |
| 5,637,560 | A | 6/1997 | Raehse et al. | |
| 6,274,540 | B1 | 8/2001 | Scheibel et al. | |
| 6,514,926 | B1 | 2/2003 | Kott et al. | |
| 6,566,319 | B1 | 5/2003 | Scheibel et al. | |
| 6,583,096 | B1 | 6/2003 | Kott et al. | |
| 6,596,680 | B2 | 7/2003 | Kott et al. | |
| 6,602,840 | B1 | 8/2003 | Scheibel et al. | |
| 6,673,961 | B2 | 1/2004 | Connor et al. | |
| 6,908,894 | B2 | 6/2005 | Kott et al. | |

FOREIGN PATENT DOCUMENTS

| | | | |
|---|---|---|---|
| DE | 42 08 773 | A1 | 9/1993 |
| WO | WO 99/05084 | A1 | 2/1999 |
| WO | WO 01/44427 | A1 | 6/2001 |

OTHER PUBLICATIONS

PCT International Search Report, date mailed: Jun. 16, 2010, 12 pages.

* cited by examiner

*Primary Examiner* — Necholus Ogden, Jr.
(74) *Attorney, Agent, or Firm* — Gary J Foose; Tiffany M Zerby

(57) ABSTRACT

A spray-drying process to prepare a spray-dried powder having: (a) anionic detersive surfactant; (b) from 0 wt % to 10 wt % zeolite builder; (c) from 0 wt % to 10 wt % phosphate builder; (d) optionally from 0 wt % to 10 wt % silicate salt; (e) optionally carbonate salt; (f) optionally polymeric material; and (g) optionally from 0 wt % to 10 wt % water, wherein, the process has the steps of: (i) spraying an aqueous slurry comprising: from (a) anionic detersive surfactant; (b) from 0 wt % to 20 wt % zeolite builder; (c) from 0 wt % to 20 wt % phosphate builder; (d) optionally from 0 wt % to 20 wt % silicate salt; (e) optionally carbonate salt; (f) optionally polymeric material; and (g) water, into a spray-drying zone, wherein the spray-drying zone is under negative pressure and wherein the air inlet air temperature into the spray-drying zone is greater than 150° C.; and (ii) drying the aqueous slurry to form a spray-dried powder.

5 Claims, No Drawings

SPRAY-DRYING PROCESS

CROSS REFERENCE TO RELATED APPLICATION(S)

This application claims the benefit of U.S. Provisional Application No. 61/159,884, filed Mar. 13, 2009.

FIELD OF THE INVENTION

The present invention relates to a spray-drying process for preparing a low built, highly soluble spray-dried powder that is suitable for incorporation into, or use as, a laundry detergent composition.

BACKGROUND OF THE INVENTION

Detergent manufacturers look to provide low density laundry detergent powders that have improved dissolution profiles at cooler washing temperatures, such as 30° C. or 20° C. Water insoluble materials, most notably zeolite builders, have been removed, or their amount present in the powder has been significantly reduced.

Furthermore, there is also a need to ensure that the environmental profile of the laundry detergent powder is as optimal as possible. This has meant that there is a trend for laundry detergent powder manufacturers to remove phosphate material, such as sodium tripolyphosphate (STPP) from the spray-dried powder.

The main process of preparing low density laundry detergent powder is to spray-dry an aqueous slurry comprising detergent ingredients. Typically, this involves spraying the aqueous slurry into a spray-drying tower that has hot air flowing through that then evaporates the water from the slurry droplets, forming spray-dried powder as the material falls down the tower.

However, the Inventors have found that when material such as zeolite and phosphate are removed from the solid content of the aqueous slurry, the temperature of the resultant spray-dried powder that is formed in the spray-drying zone has a tendency to over-heat and its temperature profile is difficult to control. The Inventors have found that the phenomenon of poor temperature control profile is a specific problem for these low built, highly soluble laundry detergent spray-dried powders and hasn't been observed to any appreciable degree before when spray-drying conventional laundry detergent powders.

The Inventors have found that this problem can be alleviated by running the spray-drying tower under a vacuum. The Inventors have found that by ensuring that the spray-drying zone is under a vacuum, i.e. such that the pressure in the spray-drying zone is negative. This ensures that ambient air is sucked into the spray-drying tower, which in turn provides a much need cooling effect on the spray-dried powder formed therein. The Inventors have found that controlling the vacuum conditions in the spray-drying zone provides good temperature control of the resultant spray-dried powder.

SUMMARY OF THE INVENTION

The present invention provides a spray-drying process as defined in claim 1.

DETAILED DESCRIPTION OF THE INVENTION

Spray-Drying Process

The spray-drying process comprises the steps of: (i) spraying an aqueous slurry comprising into a spray-drying zone, wherein the spray-drying zone is under negative pressure and wherein the air inlet air temperature into the spray-drying zone is greater than 150° C.; and (ii) drying the aqueous slurry to form a spray-dried powder. The aqueous slurry and spray-dried powder are described in more detail below.

Preferably, the spray-drying zone is under a pressure of at least $-10\ Nm^{-2}$, or at least $-20\ Nm^{-2}$, or at least $-30\ Nm^{-2}$, or at least $-40\ Nm^{-2}$, or at least $-50\ Nm^{-2}$, or at least $-60\ Nm^{-2}$, or at least $-70\ Nm^{-2}$, or at least $-80\ Nm^{-2}$, or at least $-90\ Nm^{-2}$, or at least $-100\ Nm^{-2}$, or at least $-125\ Nm^{-2}$, or at least $-1500\ Nm^{-2}$, or at least $-175\ Nm^{-2}$, or at least $-200\ Nm^{-2}$, or at least $-250\ Nm^{-2}$, or even at least $-300\ Nm^{-2}$. The higher the vacuum, the more ambient air is sucked into the bottom of the spray-drying tower and the greater the cooling effort is achieved. Typically, the maximum pressure one can use is determined by the structural strength of the spray-drying tower and care must be taken not to exceed this maximum vacuum so that no undue stress is placed on the spray-drying tower. Typically, pressures of up to $-600\ Nm^{-2}$ or up to $-500\ Nm^{-2}$ are preferably used.

Preferably, vacuum is controlled by controlling the speed and/or damper settings of the inlet and outlet air fans. For example, when setting up the spray-drying tower parameters, the inlet air fan (dilution air fan) is set to a fixed air flow rate. The speed or damper setting of the exhaust air fans is then adjusted accordingly to control the strength of the tower vacuum. Some spray-drying towers and production plants have a control loop to control the exhaust fans (and thereby the vacuum) which is normally activated about 5 minutes after start up. If more vacuum is needed the exhaust fans/dampers are adjusted accordingly. The negative pressure in the spray-drying tower can be measured by any available means. Typically pressure sensors are present in the spray-drying zone (inside the spray-drying tower).

The in-let air temperature into the spray-drying zone is preferably in the range of from greater than 150° C. to 500° C., preferably from 200° C., or from 250° C., and preferably to 450° C. or even to 400° C. The out-let (exhaust) air temperature is typically in the range of from 50° C. to 150° C., preferably from 60° C., or 70° C. or even 80° C., and preferably to 140° C., or to 130° C., or to 120° C., or to 110° C., or even to 100° C.

The temperature of the spray-dried powder exiting the spray-drying tower is typically in the range of from 50° C. to 150° C., preferably from 60° C., or even from 70° C., and preferably to 140° C., or to 130° C., or to 120° C., or to 110° C., or even to 100° C. Preferably the spray-dried powder exiting the spray-drying tower has a temperature of less than 150° C., preferably less than 140° C., or less than 130° C., or less than 120° C., or less than 110° C., and preferably less than to 100° C.

The spray-dried powder typically exits the spray-drying zone (e.g. falls from the spray-drying tower) onto a conveyor belt, where other ingredients (such as percarbonate particles) are dry-added to the powder to form a laundry detergent composition.

Aqueous Slurry

The aqueous slurry comprises (a) anionic detersive surfactant; (b) from 0 wt % to 20 wt % zeolite builder; (c) from 0 wt % to 20 wt % phosphate builder; (d) optionally from 0 wt % to 20 wt % silicate salt; (e) optionally carbonate salt; (f) optionally polymeric material; and (g) water. The aqueous slurry may comprise other detergent adjunct ingredients.

Preferably, the aqueous slurry comprises less than 15 wt %, or less than 10 wt %, or even less than 5 wt % zeolite builder. Preferably the aqueous slurry is essentially free of zeolite builder. By essentially free it is typically meant herein as meaning no deliberately added.

Preferably, the aqueous slurry comprises less than 15 wt %, or less than 10 wt %, or even less than 5 wt % phosphate builder. Preferably the aqueous slurry is essentially free of phosphate builder. By essentially free it is typically meant herein as meaning no deliberately added.

Spray-Dried Powder

The spray-dried powder comprises: (a) anionic detersive surfactant; (b) from 0 wt % to 10 wt % zeolite builder; (c) from 0 wt % to 10 wt % phosphate builder; (d) optionally from 0 wt % to 10 wt % silicate salt; (e) optionally carbonate salt; (f) optionally polymeric material; and (g) optionally from 0 wt % to 10 wt % water, The spray-dried powder preferably comprises: (a) from 0 wt % to 2 wt % zeolite builder; (b) from 0 wt % to 2 wt % phosphate builder; and (c) optionally, from 0 wt % to 2 wt % silicate salt.

Preferably, the spray-dried powder comprises less than 8 wt %, or less than 6 wt %, or even less than 4 wt % zeolite builder. Preferably the spray-dried powder is essentially free of zeolite builder. By essentially free it is typically meant herein as meaning no deliberately added.

Preferably, the spray-dried powder comprises less than 8 wt %, or less than 6 wt %, or even less than 4 wt % phosphate builder. Preferably the spray-dried powder is essentially free of phosphate builder. By essentially free it is typically meant herein as meaning no deliberately added.

It may be preferred for the spray-dried powder to comprise a silicate salt, preferably from 1 wt % to 10 wt % silicate salt.

Anionic Detersive Surfactant

The anionic detersive surfactant preferably comprises alkyl benzene sulphonate. Preferably the anionic detersive surfactant comprises at least 50%, preferably at least 55%, or at least 60%, or at least 65%, or at least 70%, or even at least 75%, by weight of the anionic detersive surfactant, of alkyl benzene sulphonate. Preferably the alkyl benzene sulphonate is a linear or branched, substituted or unsubstituted, $C_{8-18}$ alkyl benzene sulphonate. This is the optimal level of the $C_{8-18}$ alkyl benzene sulphonate to provide a good cleaning performance. The $C_{8-18}$ alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred C8-18 alkyl benzene sulphonates are linear $C_{10-13}$ alkylbenzene sulphonates. Especially preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

The anionic detersive surfactant may preferably comprise other anionic detersive surfactants. A preferred adjunct anionic detersive surfactant is a non-alkoxylated anionic detersive surfactant. The non-alkoxylated anionic detersive surfactant can be an alkyl sulphate, an alkyl phosphate, an alkyl phosphonate, an alkyl carboxylate or any mixture thereof. The non-alkoxylated anionic surfactant can be selected from the group consisting of; $C_{10-C20}$ primary, branched chain, linear-chain and random-chain alkyl sulphates (AS), typically having the following formula:

$$CH_3(CH_2)xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$—$C_{18}$ secondary (2,3) alkyl sulphates, typically having the following formulae:

$$CH_3(CH_2)_x(\overset{\overset{OSO_3^-M^+}{|}}{CH})CH_3 \quad \text{or} \quad CH_3(CH_2)_y(\overset{\overset{OSO_3^-M^+}{|}}{CH})CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$—$C_{18}$ alkyl carboxylates; mid-chain branched alkyl sulphates as described in more detail in U.S. Pat. Nos. 6,020,303 and 6,060,443; methyl ester sulphonate (MES); alpha-olefin sulphonate (AOS); and mixtures thereof.

Another preferred anionic detersive surfactant is an alkoxylated anionic detersive surfactant. The presence of an alkoxylated anionic detersive surfactant in the spray-dried powder provides good greasy soil cleaning performance, gives a good sudsing profile, and improves the hardness tolerance of the anionic detersive surfactant system. It may be preferred for the anionic detersive surfactant to comprise from 1% to 50%, or from 5%, or from 10%, or from 15%, or from 20%, and to 45%, or to 40%, or to 35%, or to 30%, by weight of the anionic detersive surfactant system, of an alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 1 to 10. Preferably, the alkoxylated anionic detersive surfactant is a linear or branched, substituted or unsubstituted $C_{12-18}$ alkyl ethoxylated sulphate having an average degree of ethoxylation of from 1 to 10. Most preferably, the alkoxylated anionic detersive surfactant is a linear unsubstituted $C_{12-18}$ alkyl ethoxylated sulphate having an average degree of ethoxylation of from 3 to 7.

The alkoxylated anionic detersive surfactant, when present with an alkyl benzene sulphonate may also increase the activity of the alkyl benzene sulphonate by making the alkyl benzene sulphonate less likely to precipitate out of solution in the presence of free calcium cations. Preferably, the weight ratio of the alkyl benzene sulphonate to the alkoxylated anionic detersive surfactant is in the range of from 1:1 to less than 5:1, or to less than 3:1, or to less than 1.7:1, or even less than 1.5:1. This ratio gives optimal whiteness maintenance performance combined with a good hardness tolerance profile and a good sudsing profile. However, it may be preferred that the weight ratio of the alkyl benzene sulphonate to the alkoxylated anionic detersive surfactant is greater than 5:1, or greater than 6:1, or greater than 7:1, or even greater than 10:1. This ratio gives optimal greasy soil cleaning performance combined with a good hardness tolerance profile, and a good sudsing profile.

Suitable alkoxylated anionic detersive surfactants are: Texapan LESTTM by Cognis; Cosmacol AESTM by Sasol; BES151™ by Stephan; Empicol ESC70/UTM; and mixtures thereof.

Preferably, the anionic detersive surfactant comprises from 0% to 10%, preferably to 8%, or to 6%, or to 4%, or to 2%, or even to 1%, by weight of the anionic detersive surfactant, of unsaturated anionic detersive surfactants such as alpha-olefin sulphonate. Preferably the anionic detersive surfactant is essentially free of unsaturated anionic detersive surfactants such as alpha-olefin sulphonate. By "essentially free of" it is typically meant "comprises no deliberately added". Without wishing to be bound by theory, it is believed that these levels of unsaturated anionic detersive surfactants such as alpha-olefin sulphonate ensure that the anionic detersive surfactant is bleach compatible.

Preferably, the anionic detersive surfactant comprises from 0% to 10%, preferably to 8%, or to 6%, or to 4%, or to 2%, or even to 1%, by weight of alkyl sulphate. Preferably the anionic detersive surfactant is essentially free of alkyl sulphate. Without wishing to be bound by theory, it is believed that these levels of alkyl sulphate ensure that the anionic detersive surfactant is hardness tolerant.

Zeolite Builder

Suitable zeolite builders include zeolite A, zeolite X, zeolite P and zeolite MAP.

Phosphate Builder

Suitable phosphate builders include sodium tripolyphosphate.

Silicate Salt

Suitable silicate salts include amorphous silicates and crystalline layered silicates (e.g. SKS-6). A preferred silicate salt is sodium silicate.

Carbonate Salt

Suitable carbonate salts include sodium salts of carbonate and/or bicarbonate. A highly preferred carbonate salt is sodium carbonate.

Polymeric Material

A preferred polymeric material is a polymeric carboxylate, such as a co-polymer of maleic acid and acrylic acid. However, other polymers may also be suitable, such as polyamines (including the ethoxylated variants thereof), polyethylene glycol and polyesters. Polymeric soil suspending aids and polymeric soil release agents are also particularly suitable.

Adjunct Detergent Ingredients

Suitable adjunct detergent ingredients include: detersive surfactants such as nonionic detersive surfactants, cationic detersive surfactants, zwitterionic detersive surfactants, amphoteric detersive surfactants; preferred nonionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; and dyes such as orange dye, blue dye, green dye, purple dye, pink dye, or any mixture thereof.

Preferably, no bleach adjunct ingredients, such as sodium percarbonate and/or sodium perborate, are spray-dried. Typically, these adjunct detergent ingredients are dry-added to the spray-dried powder and are not subjected to the higher temperatures and vacuum of the above described spray-drying process.

EXAMPLES

Example 1

A Spray-Dried Laundry Detergent Powder and Process of Making it

Aqueous Slurry Composition.

| Component | % w/w Aqueous slurry |
|---|---|
| Linear alkyl benzene sulphonate | 10.6 |
| Acrylate/maleate copolymer | 4.6 |
| Ethylenediamine disuccinic acid and/or Hydroxyethane di(methylene phosphonic acid) | 1.4 |
| Sodium carbonate | 19.4 |
| Sodium sulphate | 28.6 |
| Water | 34.0 |
| Miscellaneous, such as magnesium sulphate, brightener, and one or more stabilizers | 1.4 |
| Total Parts | 100.00 |

Preparation of a Spray-Dried Laundry Detergent Powder.

An aqueous slurry having the composition as described above is prepared having a moisture content of 34.0%. Any ingredient added above in liquid form is heated to 70° C., such that the aqueous slurry is never at a temperature below 70° C. At the end of preparation, the aqueous slurry is heated to 80° C. and pumped under pressure ($7.5\times10^6$ $Nm^{-2}$), into a counter current spray-drying tower with an air inlet temperature of from between 250° C. to 330° C. The in-let air fan is set such that the tower in-let air-flow is 187,500 $kgh^{-1}$. The exhaust air fan is controlled to give a negative pressure in the tower of −200 $Nm^{-2}$ (typically the out-let air flow rate through the exhaust fan is between 220,000 $kgh^{-1}$ to 240,000 $kgh^{-1}$, this includes the evaporated water from the slurry). The aqueous slurry is atomised and the atomised slurry is dried to produce a solid mixture, which is then cooled and sieved to remove oversize material (>1.8 mm) to form a spray-dried powder, which is free-flowing. Fine material (<0.175 mm) is elutriated with the exhaust the exhaust air in the spray-drying tower and collected in a post tower containment system. The spray-dried powder has a moisture content of 2.0 wt %, a bulk density of 350 g/l and a particle size distribution such that greater than 90 wt % of the spray-dried powder has a particle size of from 175 to 710 micrometers. The temperature of the powder exiting the tower has a temperature of below 150° C. The composition of the spray-dried powder is given below.

Spray-Dried Laundry Detergent Powder Composition.

| Component | % w/w Spray Dried Powder |
|---|---|
| Linear alkyl benzene sulphonate | 15.8 |
| Acrylate/maleate copolymer | 6.8 |
| Ethylenediamine disuccinic acid and/or Hydroxyethane di(methylene phosphonic acid) | 2.1 |
| Sodium carbonate | 28.7 |
| Sodium sulphate | 42.4 |
| Water | 2.0 |
| Miscellaneous, such as magnesium sulphate, brightener, and one or more stabilizers | 2.2 |
| Total Parts | 100.00 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A spray-drying process to prepare a spray-dried powder comprising:

(a) anionic detersive surfactant;
(b) substantially free of zeolite builder;
(c) substantially free of phosphate builder;
(d) from 0 wt % to 10 wt % silicate salt;
(e) optionally carbonate salt;
(f) optionally polymeric material; and
(g) optionally from 0 wt % to 10 wt % water, wherein, the process comprises the steps of:

(i) spraying an aqueous slurry comprising from
  (a) anionic detersive surfactant;
  (b) substantially free of zeolite builder;
  (c) substantially free of phosphate builder;
  (d) from 0 wt % to 20 wt % silicate salt;
  (e) optionally carbonate salt;
  (f) optionally polymeric material; and
  (g) water, into a spray-drying zone, wherein the spray-drying zone comprises a vacuum, and wherein the spray-drying zone is under negative pressure of at least $-80\ Nm^{-2}$ and wherein the air inlet air temperature into the spray-drying zone is greater than 150° C.; and (ii) drying the aqueous slurry to form a spray-dried powder.

2. A spray-drying process according to claim 1, wherein the spray-drying zone is under a pressure of at least $-100\ Nm^{-2}$.

3. A spray-drying process according to claim 1, wherein the spray-drying zone is under a pressure of at least at least $-200\ Nm^{-2}$.

4. A spray-drying process according to claim 1, wherein the spray-dried powder is substantially free of zeolite builder and phosphate builder.

5. A spray-drying process according to claim 1, wherein the spray-dried powder exiting the spray-drying zone has a temperature of less than 150° C.

* * * * *